US008480334B2

(12) United States Patent
Rodenbusch et al.

(10) Patent No.: US 8,480,334 B2
(45) Date of Patent: Jul. 9, 2013

(54) HYBRID RISER SYSTEMS AND METHODS

(75) Inventors: George Rodenbusch, Houston, TX (US); Heping Zhang, Cypress, TX (US); Qing Jane Zhang, Sugarland, TX (US)

(73) Assignee: Shell Oil Company, Houston, TX (US)

( * ) Notice: Subject to any disclaimer, the term of this patent is extended or adjusted under 35 U.S.C. 154(b) by 707 days.

(21) Appl. No.: 12/444,212

(22) PCT Filed: Oct. 3, 2007

(86) PCT No.: PCT/US2007/080273

§ 371 (c)(1), (2), (4) Date: Dec. 22, 2009

(87) PCT Pub. No.: WO2008/042943

PCT Pub. Date: Apr. 10, 2008

(65) Prior Publication Data

US 2010/0129161 A1 May 27, 2010

Related U.S. Application Data

(60) Provisional application No. 60/828,365, filed on Oct. 5, 2006.

(51) Int. Cl.
*B63B 22/00* (2006.01)

(52) U.S. Cl.
USPC ..... 405/224.3; 114/230.13

(58) Field of Classification Search
USPC ..... 405/168.1, 168.2, 224, 224.2, 224.3, 405/224.4; 114/230.13, 293; 441/5
See application file for complete search history.

(56) References Cited

U.S. PATENT DOCUMENTS

| | | | | |
|---|---|---|---|---|
| 5,195,848 | A * | 3/1993 | Huete et al. | 405/202 |
| 5,288,253 | A * | 2/1994 | Urdshals et al. | 441/5 |
| 5,305,703 | A * | 4/1994 | Korsgaard | 441/4 |
| 5,342,148 | A * | 8/1994 | Huete et al. | 405/223.1 |
| 5,582,252 | A * | 12/1996 | Richmond et al. | 166/352 |
| 5,957,074 | A * | 9/1999 | de Baan et al. | 114/230.12 |
| 6,558,215 | B1 * | 5/2003 | Boatman | 441/5 |
| 2004/0065475 | A1 * | 4/2004 | Laursen et al. | 175/7 |
| 2005/0063788 | A1 * | 3/2005 | Clausen | 405/224.2 |
| 2005/0158126 | A1 | 7/2005 | Luppi | 405/224.2 |
| 2005/0196242 | A1 | 9/2005 | Masetti et al. | 405/158 |

FOREIGN PATENT DOCUMENTS

WO WO03012327 2/2003

* cited by examiner

*Primary Examiner* — Tara M. Pinnock

(57) ABSTRACT

There is disclosed a floating system positioned in a body of water having a water bottom, the system comprising a host member floating on a surface of the water; a flotation module floating under the surface of the water; a flexible hose connecting the host member to the flotation module; and an elongated underwater line structure, comprising a top portion connected to the flotation module; a bottom portion extending to the water bottom and adapted to connect to a flowline lying on the water bottom; and at least one of the top portion and the bottom portion comprising a catenary configuration.

21 Claims, 9 Drawing Sheets

HYBRID RISER SYSTEMS AND METHODS

PRIORITY CLAIM

The present application claims priority of U.S. Provisional Application No. 60/828,365 filed 5 Oct. 2006.

FIELD OF THE INVENTION

The present invention relates to systems of underwater line structures extending from a floating structure at the sea surface to the seabed, and relates to the processes of installing and using such systems.

DESCRIPTION OF THE RELATED ART

Several configurations for connecting a floating structure (host) with a seabed pipeline have been proposed. The configurations used depend, in general, on parameters relating to the depth of water and the horizontal and vertical movements of the floating structure in order to select the appropriate configuration and/or the type of connection.

One configuration is the top-tensioned riser, or vertical rigid riser. In this configuration, the riser vertically stands on a foundation at the seabed. Near its top, the riser is pulled upward by a tensioning system (or a buoyancy system) at the floating structure. The tensioning system (or buoyancy system) is designed so that the riser top portion follows the horizontal motion of the host but slides with respect of the host in vertical direction (stroke) to compensate for host heave (vertical) motions. The host horizontal motions can still reach to the riser bottom and induce quite large bending stresses at the riser bottom. Stress joints are often built at the riser bottom to reduce the bending stress by the host horizontal motions.

More recently, another configuration, called a Steel Catenary riser (SCR), has emerged. With its top hung on the host, a steel catenary riser forms a catenary configuration in the water, until it touches down on the seabed, connecting to the flowlines lying on the seabed linking to other offshore or onshore facilities. The riser bending at the touchdown region should not cause the riser pipe stress to exceed the yield stress of the metallic material of which the SCR is made. The host motions are absorbed by the catenary configurations. The requirements on the foundation and tensioning system are eliminated. However, if the host has significant oscillations, the motion can pass to the riser, especially to the touchdown region, and reduce the fatigue life of the steel catenary riser.

A flexible pipe may also be used in deep seas in the free-hanging configuration. It has advantages over the SCR, for example, a far smaller radius of curvature is allowed along the riser length. It allows greater vertical and horizontal movements of the host at the water surface due to better fatigue behavior. However, it may have the drawbacks of being heavy and having a high cost.

A hybrid configuration of a riser consists of a vertical steel pipe and flexible hoses (jumpers). Its lower part is a vertical rigid pipe standing on a seabed foundation and supported by a buoyancy member at its top. The upper portion is a flexible hose connecting the rigid riser top to the host. The steel pipe in the lower portion is almost completely isolated from the host motions by the jumpers, and its bottom bending moment is mainly induced by direct wave and current load to the buoyancy member and the steel pipe. The riser can stand alone, even disconnected from the host under certain circumstances. Furthermore, since some weight of the riser in the seawater is supported by the buoyancy member; the host deck load requirement is reduced. This is especially important for the host with a small deck load capacity available.

With the foundation (and accessories) and stress joint at the bottom, and buoyancy member and flexible hose at the top, the cost of the hybrid riser may be higher than a conventional top-tension riser or steel catenary riser. The relative distance of the host and the steel pipe top may have quite large variations if the host has a large offset and horizontal oscillations, due to the almost complete motion isolations between them. The flexible hose should be sufficiently long, such as 1500 ft, to avoid excessive bending curvature or end rotations. The cost of the hybrid riser may limit the number of its applications.

There is a need in the art for a new form of hybrid riser.

There is a need in the art for a new form of hybrid riser which can be used with a pipe in a catenary configuration.

There is a need in the art for a new form of hybrid riser without the need for a riser base and/or tiebacks.

SUMMARY OF THE INVENTION

In one aspect, the invention provides a floating system positioned in a body of water having a water bottom, the system comprising a host member floating on a surface of the water; a flotation module floating under the surface of the water; a flexible hose connecting the host member to the flotation module; and an elongated underwater line structure, comprising a top portion connected to the flotation module; a bottom portion extending to the water bottom and adapted to connect to a flowline lying on the water bottom; and at least one of the top portion and the bottom portion comprising a catenary configuration.

In one aspect, the invention provides a method of modifying a floating system, the system comprising a host floating in a body of water having a water bottom, an elongated underwater structure with a first end, a second end, and a body positioned between the first end and the second end, with the first end connected to the host, the body extending through the water, and the second end adjacent the water bottom, the method comprising disconnecting the first end from the host; connecting the first end to a flotation module; connecting a flexible hose to the flotation module and the host; and maintaining the flotation module at a depth below a surface of the body of water.

DETAILED DESCRIPTION

Figure 1:
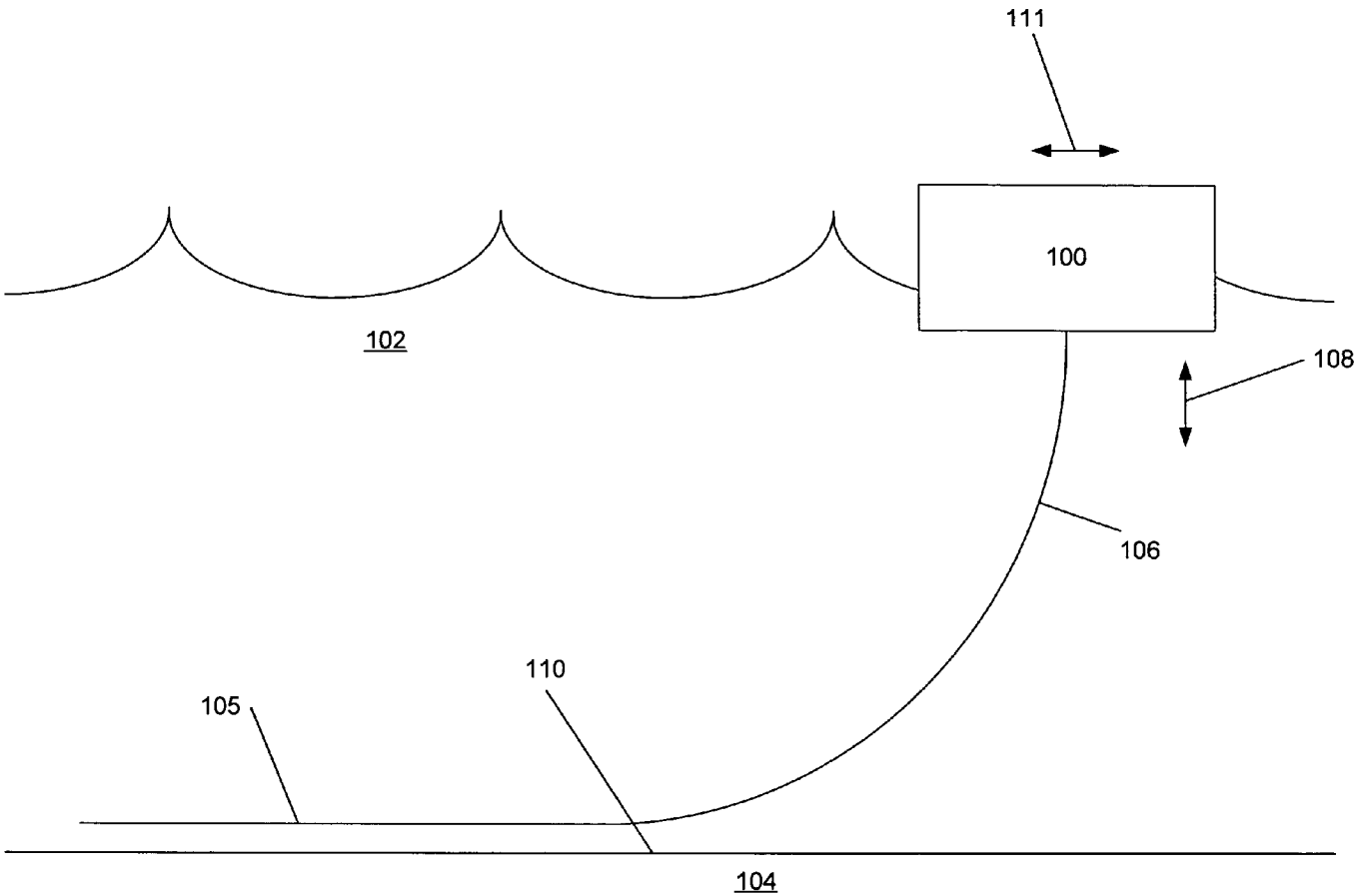
FIG. 1 is a schematic representation of a prior art system including a steel catenary riser (SCR) 106 in the catenary configuration from host vessel 100, connected to horizontal pipe line 105, with touchdown region 110 on water bottom 104.

In one embodiment, there is provided a floating system positioned in a body of water having a water bottom, the system comprising a host member floating on a surface of the water; a flotation module floating under the surface of the water; a flexible hose connecting the host member to the flotation module; and an elongated underwater line structure, comprising a top portion connected to the flotation module; a bottom portion extending to the water bottom and adapted to connect to a flowline lying on the water bottom; and at least one of the top portion and the bottom portion comprising a catenary configuration. In some embodiments, the elongated underwater structure comprises a steel catenary riser. In some embodiments, the system also includes a line connecting the host member to the flotation module. In some embodiments, the line comprises a heavy chain or other heavy line member with sufficient mass to produce a horizontal force required to form a catenary configuration of the elongated underwater line structure. In some embodiments, the system also includes an anchor member connected to the elongated underwater line structure. In some embodiments, the flexible hose comprises a sufficient mass to produce a horizontal force required to form a catenary configuration of the elongated underwater line structure. In some embodiments, the system also includes a taut line connecting the host member to the flotation module to produce a horizontal force required to form a catenary configuration of the elongated underwater line structure. In some embodiments, the system also includes a plurality of anchor members connected to the elongated underwater line structure. In some embodiments, the system also includes a concrete bell-mouth sitting on the water bottom, which makes the bottom portion, in an emergency, stand in the water by itself without any connections to the host, resulting in plastic bending deformation without material rupture. In some embodiments, the flotation module is floating at a depth from about 25 to 100 meters below the surface of the water. In some embodiments, the elongated underwater line structure comprises at least one of a pre-curved shore pipe, a bell-mouth, a bending restrictor, a tapered stress joint, a titanium stress joint, a flexible hose, and a deep-water flexible joint. In some embodiments, the system also includes a set of bending restrictors sitting on the water bottom, which makes the bottom portion, in an emergency, stand in the water by itself without any connections to the host, resulting in plastic bending deformation without material rupture. In some embodiments, the bottom portion comprises a catenary configuration. In some embodiments, the elongated underwater line structure is adapted to be disconnected from the host member and stand in the water by itself. In some embodiments, the host member is allowed to move away due to severe environmental conditions or other situations with disconnection of the flexible hose, and the elongated underwater line structure is supported by the flotation module vertically and an anchor horizontally. In some embodiments, the system also includes an anchor member connected to an anchoring point in the elongated underwater line structure, which is slack in normal working conditions and in no use.

In one embodiment, there is provided a method of modifying a floating system, the system comprising a host floating in a body of water having a water bottom, an elongated underwater structure with a first end, a second end, and a body positioned between the first end and the second end, with the first end connected to the host, the body extending through the water, and the second end adjacent the water bottom, the method comprising disconnecting the first end from the host; connecting the first end to a flotation module; connecting a flexible hose to the flotation module and the host; and maintaining the flotation module at a depth below a surface of the body of water. In some embodiments, the method also includes anchoring the body of the elongated underwater structure to the water bottom. In some embodiments, an anchor line is connected to the body of the elongated underwater structure from 25 meters to 250 meters above the water bottom. In some embodiments, the elongated underwater structure comprises a steel catenary riser. In some embodiments, the flotation module at a depth from 5 to 50 meters below the surface of the body of water.

A top tensioned riser has its bottom fixed to the riser base on the seabed, and its top is supported by a tensioning system of the host (or buoyancy members vertically guided by the host). The tensioning system (or guided buoyancy system) may supply an almost constant tension to the riser to prevent the riser buckling. The riser top can slide vertically relative to the host, however, the riser moves with the host in the horizontal directions. The host horizontal motions under waves/currents/winds together with the wave/current loads at the riser upper portion may pass to the riser bottom portions to induce excessive bending stress. Stress joints at the riser bottom may be used to reduce the bending stress level.

The steel catenary riser is a conventional form of a riser system. Referring to FIG. 1, there is illustrated vessel 100 floating in body of water 102. Body of water has a bottom (seabed) 104. Flowline 105 lies on bottom 104. Steel catenary riser 106 is hung on vessel 100 and extends into the water in a catenary configuration to touch down area 110 at water bottom 104 to connect flowline 105.

Waves/currents/winds may cause vessel vertical oscillations (i.e., heave oscillations as shown by arrow 108), and horizontal offset and oscillations (as shown by arrow 111) and rotational motion. As vessel 100 moves, catenary riser 106 may be bent and moved, and the touchdown point 110 may move as riser 106 moves. For a host with large oscillations, the life of the SCR near the touchdown point may be lower than required due to fatigue damage.

Figure 2:
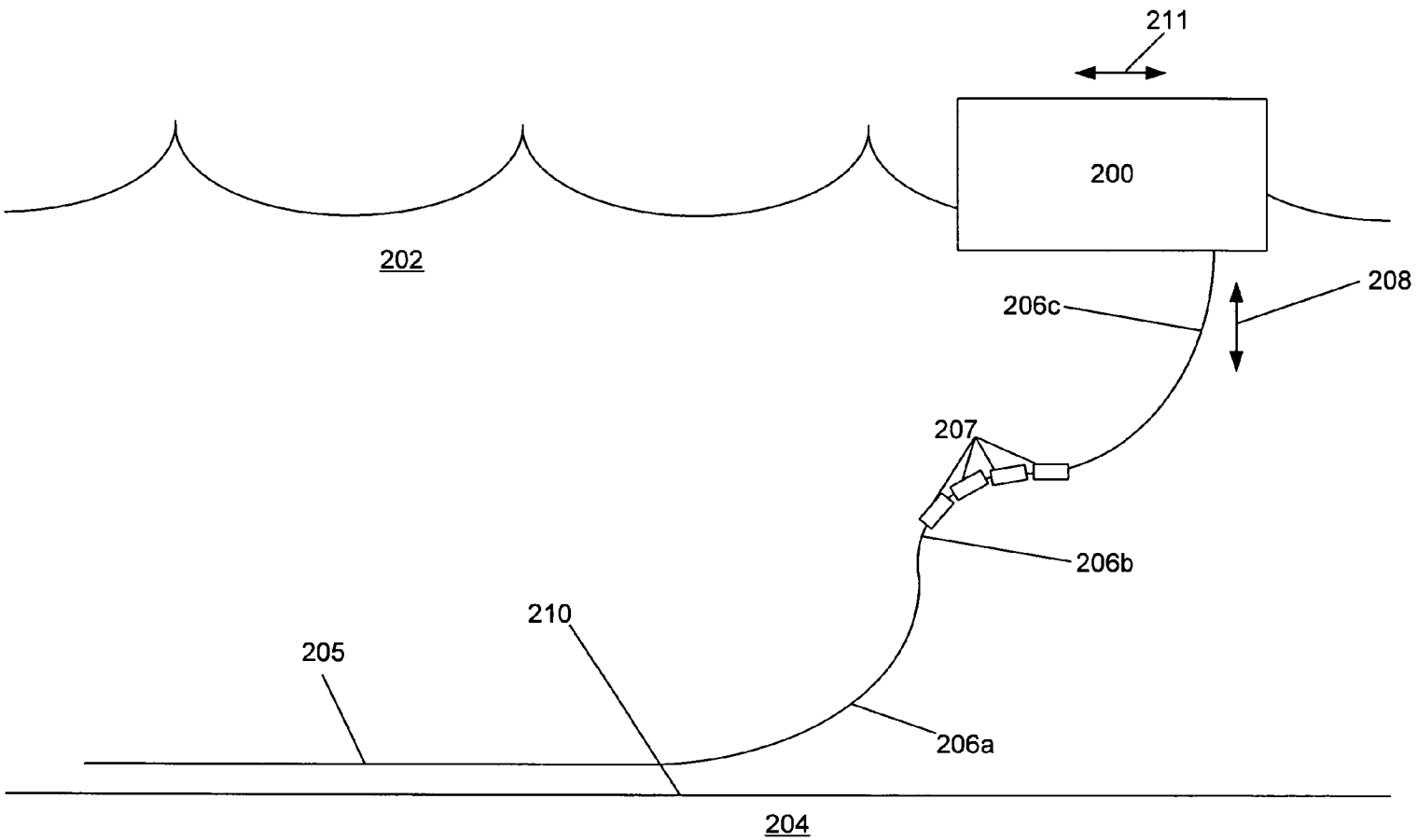
FIG. 2 is an evolution of the steel catenary riser, with extra buoyancy modules 207 attached to a segment of pipe 206. The oscillations (shown as arrows 211 and 208) of vessel 200 will be separated from lower portion 206*a* of the riser and the fatigue damage to touch down region 210 can be reduced.

Referring now to FIG. 2, vessel 200 is shown floating in body of water 202. Body of water 202 has bottom 204. Flowline 205 is on or near bottom 204 and transitions to riser first portion 206*a*, to riser second portion 206*b*, to riser third portion 206*c*. The touchdown point 210 is at the transition from flowline 205 to riser portion 206*a*. Vessel 200 may heave up and down (shown by arrows 208), as well as have horizontal motions (shown by arrows 211) and have rotational motion. Buoyant modules 207 capable of resisting the water pressure at the depth of portion 206*b* are attached to riser portion 206*b*. Buoyant modules 207 are designed to isolate riser portion 206*a* from heave motion 208, so that only riser portions 206*c* and 206*b* flex with heave 208. The touchdown region of the riser is protected. Riser with buoyancy modules attached may have difficulty in pre-laying operations.

Figure 3:
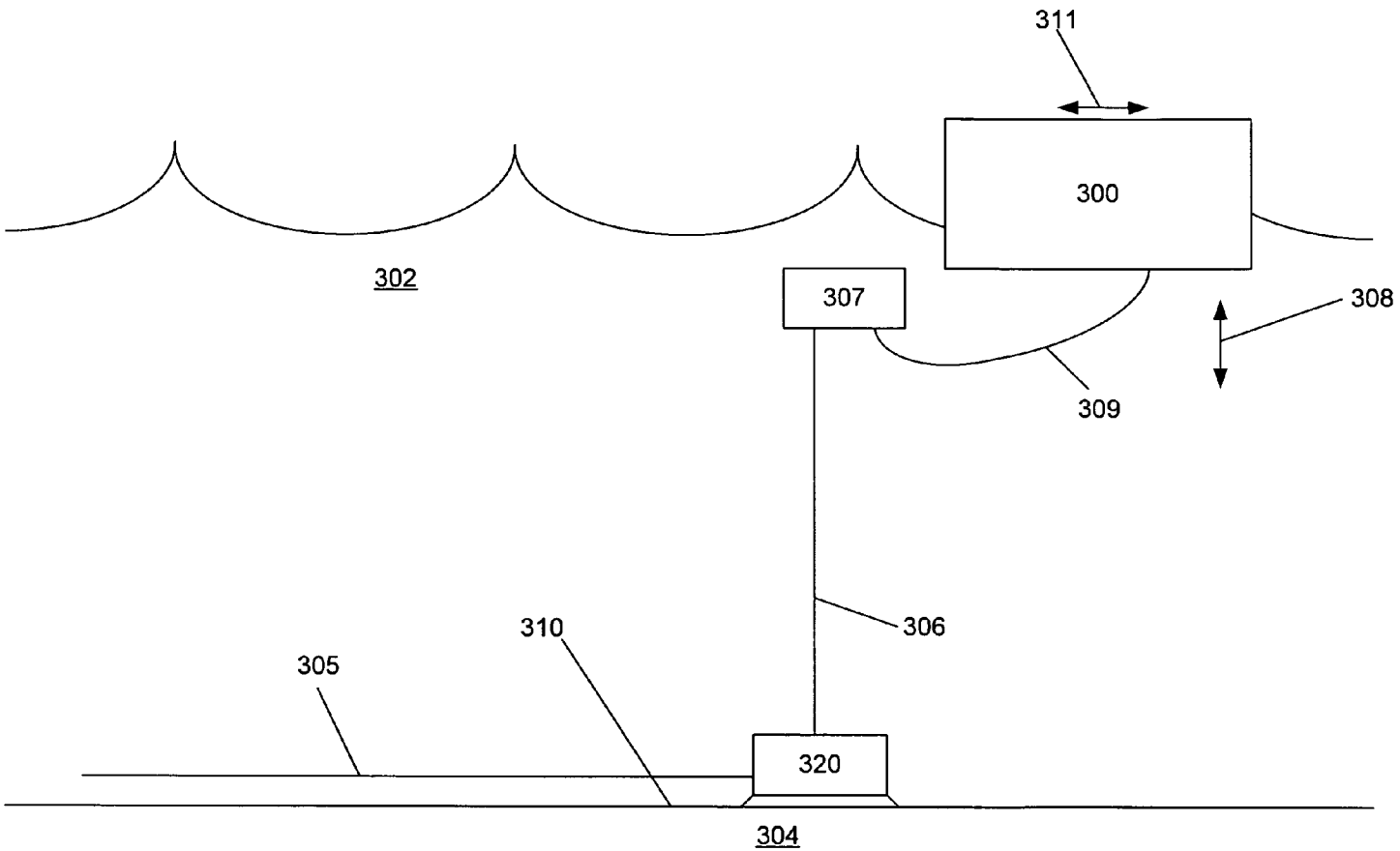
FIG. 3 is a hybrid of concepts of rigid vertical riser and a flexible hose. The vertical pipe 306 stands on water bottom 304, with its bottom fixed to base 320, where pipe 306 is connected to seabed flowline 305. Pipe 306 is vertically supported by buoyancy member 307, and connected to vessel 300 by flexible hose 309. Horizontal offsets and horizontal and vertical oscillations (arrows 311 and 308) of vessel 300 are absorbed by flexible hose 309.

Referring now to FIG. 3, a hybrid riser system is illustrated, which is a combination of a flexible hose and a vertical rigid riser. Vessel 300 is shown floating in body of water 302. Body of water has bottom 304. Flowline 305 is at or near bottom 304 and connects by tieback connectors to riser base assembly 320, which is fixed to bottom 304. Steel pipe riser 306 is rigidly connected to riser base assembly 320, and is supported by buoyant module 307. Jumper 309 connects the top of steel pipe 306 with vessel 300.

Vessel 300 may have offsets and oscillations as shown by arrows 308 and 311, which cause movement of jumper 309, but the vessel motion may be isolated from buoyant module 307 and riser 306. The steel pipe riser 306 stands with little movement with the vessel motions. However, the direct wave/current load to buoyancy module 307 and the upper portion of pipe 306 can be passed to the bottom of 306 and still cause unacceptable bending stresses. Stress joints may be required for stress reductions. The riser system can be free-standing: disconnected from the host vessel 300. The riser system can still stand in the water without collapse, which is one of the main features different from other riser forms. The freestanding pipe can be utilized for pre-installation before the host vessel arrives. In case the flexible hose 309 is disconnected when the vessel moves away to escape a severe environmental condition, the riser 306 can still stand on its base.

In some embodiments, there is provided a combination of a flexible hose jumper with a steel catenary riser. The steel pipe with a catenary configuration may be hung on a buoyancy member, with a flexible hose connecting the top of the steel pipe to the host vessel.

Figure 4:
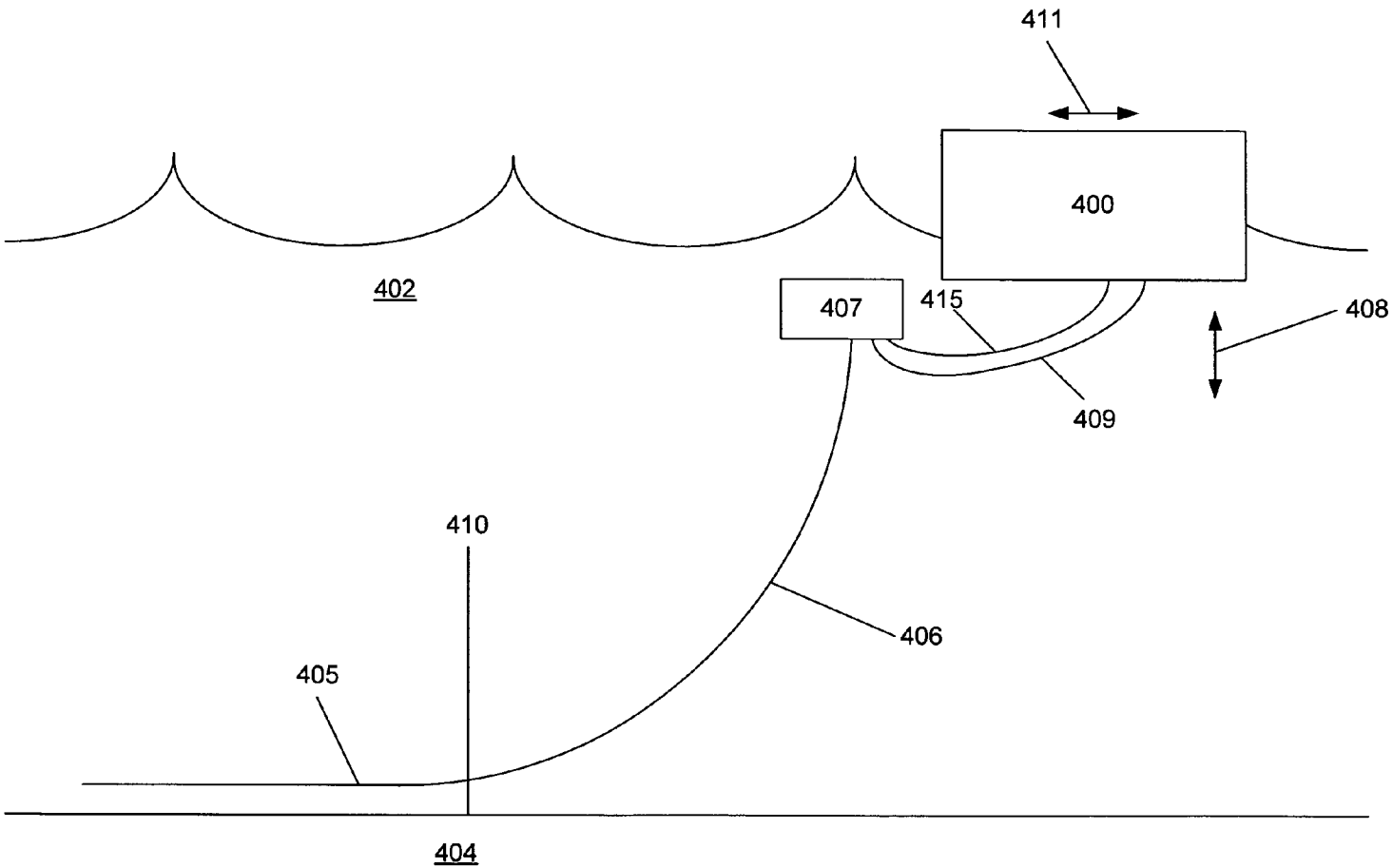
FIG. 4 illustrates a steel catenary pipe 406 reaching water bottom 404 at touchdown point 410. Its top is supported by buoyancy member 407, and is connected with vessel 400 by flexible hose 409. The bottom tension required by the catenary configuration is supplied by the weights of flexible hose 409 and chain 415. The vertical load to vessel 400 is much smaller than the weight of entire underwater line structure. The vertical oscillation (arrow 408) is isolated from touchdown region 410. Buoyancy member 407 horizontally moves with vessel 400 (arrow 411), and length of flexible hose 409 may be relatively short.

In order to form a catenary configuration, a horizontal force (which is called the bottom tension) may be supplied by a top horizontal load. Referring now to FIG. 4, vessel 400 is shown floating in body of water 402. Body of water 402 has bottom 404. Flowline 405 is at or near bottom 404, which flowline 405 transitions into catenary pipe 406. Pipe 406 is hung on buoyant module 407 in a catenary configuration. Flexible hose 409 connects the top of pipe 406 by means of a gooseneck, Y-tube, or other suitable forms of connectors. On the other end, flexible hose 409 is connected to vessel 400 for the communication of the contents inside pipe 406 and the host vessel. Hung on vessel 400 and buoyancy 407 at its two ends, hose 409 supplies a horizontal force to pipe 406 for the requirement of formation of a catenary configuration of pipe 406. If flexible hose 407 alone is not be able to supply sufficient horizontal force required, (for example from about 10 to about 100 tons), then flexible hose 407 can be attached to weights or tangled with a chain. Also, chain 415 may be hung on vessel 100 and buoyancy means 407 in order to provide additional force to form catenary configuration. The catenary line of chain 415 may be made slightly higher than the catenary line of hose 407 to avoid interference.

Chain 415, together with hose 409, has a horizontal stiffness to force buoyancy member 407 (and the top of steel pipe 406) to move roughly in tandem with vessel 400 in horizontal direction. Flexible hose 407 may have a relatively small curvature along its length and small rotations at its ends.

Vertical oscillations (arrow 108) of vessel 400 are largely absorbed by hose 409 and chain 415. Touchdown region 410 is protected from fatigue damage. The weight of hose 409 and chain 415 to be supported by vessel 400 is much smaller than the weight of pipe 406, which is important for a vessel with a small deck load capacity available.

Compared to a hybrid riser, as described in FIG. 3, this embodiment eliminates the need for riser base 320, tieback connections and stress joints.

The weight of pipe 407 may be supported by buoyancy member 407. This embodiment of the line structure is difficult to be freestanding, without a connection to vessel 400. If there is no connection to vessel 400, pipe 406 may strike on seabed 404 with severe bending due to a lack of the bottom tension necessary for a catenary configuration. The bending can be so severe as to cause pipe leakage. To avoid this problem, a heavy block (such as made of concrete) with a bell-mouth sitting on seabed 404 may restrict pipe 406 bending at the seabed in case of disconnection of vessel 400. Bending restrictors, such as a number of collars outside of pipe 406 along a length of 20 to 50 meters, can also restrict the bending stress below the breaking strength. The purpose of these methods is to let the pipe to have plastic (permanent) deformations without breaking, in the case of a situation in which vessel 400 has to be disconnected from the line structure.

Chain 415 can be replaced by wire, cable, rope, with or without the attachment of weights to achieve sufficient horizontal force required by the catenary configuration for pipe 406. An alternative method is to make flexible hose 407 have sufficient weight.

Any of the numerous buoyancy materials as are known in the art may be utilized, for example a foam or buoyancy can. Buoyancy member 407 may incorporate materials with densities suitable to provide buoyancy, and/or may incorporate voids or hollow members to provide buoyancy.

In some embodiments, an installation method is to lay down pipe 406 by a laying barge to the seafloor as the first step. Later, according to the schedule, a barge lifts the top of one of the pipes by a winch to the surface while pulling horizontally to forming a catenary configuration. The pipe top is connected to buoyancy member 407 and flexible hose 409 and chain 415. Then the other ends of flexible hose 409 and chain 415 are connected to vessel 400.

Figure 5:
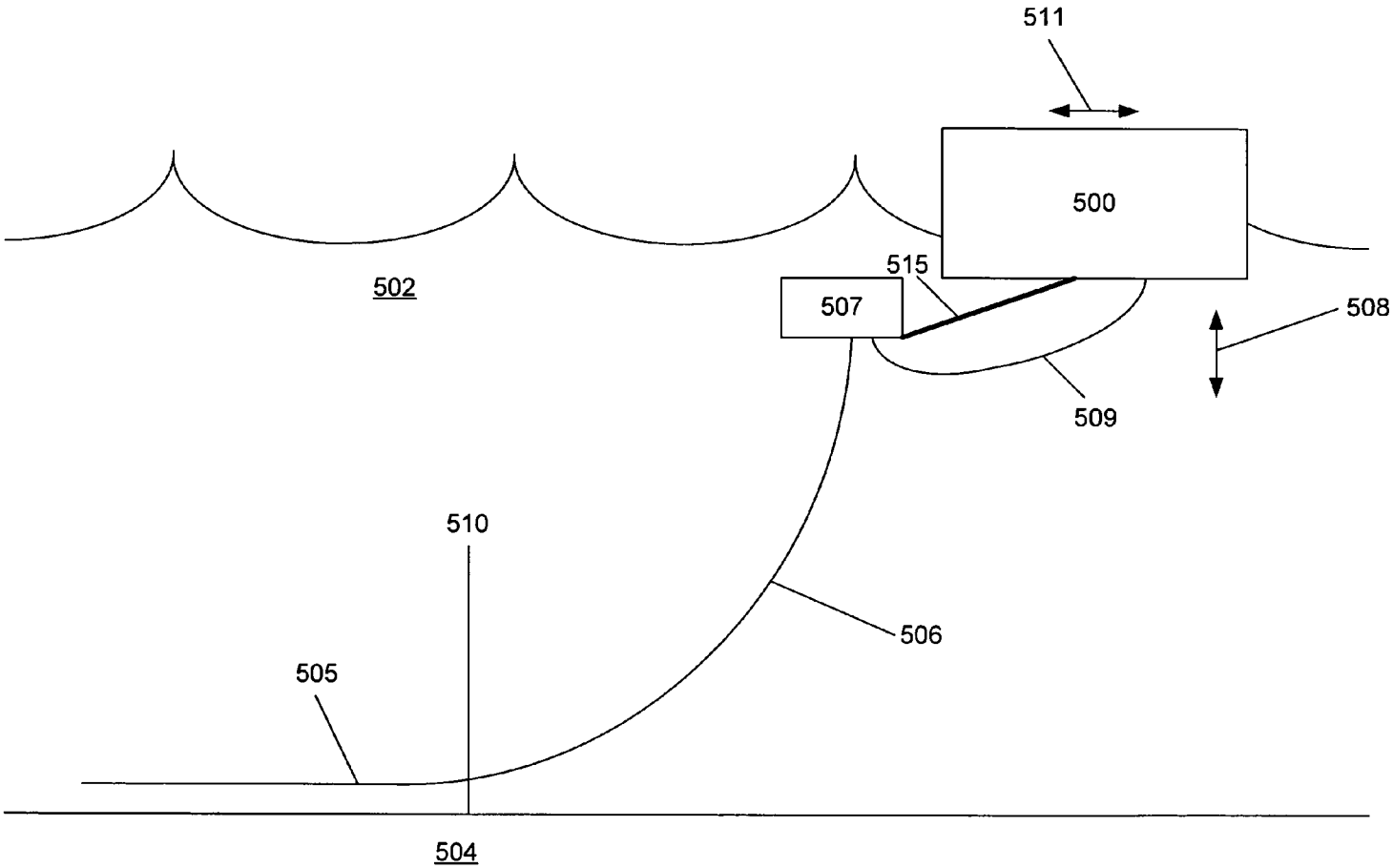
FIG. 5 is a variation of FIG. 4, in which chain 415 is replaced by taut line 515. The bottom tension required by the catenary configuration is supplied by the tension in taut line 515.

In some embodiments, referring now to FIG. 5, the horizontal force for forming the catenary configuration of pipe 506 is supplied by taut cable 515 (or rope, chain, or line).

Suitable materials include metals and polymers, such as steel or polyester. The vertical loads to vessel 500 and buoyancy member 507 may be reduced when a chain is replaced with a taut cable.

Figure 6:
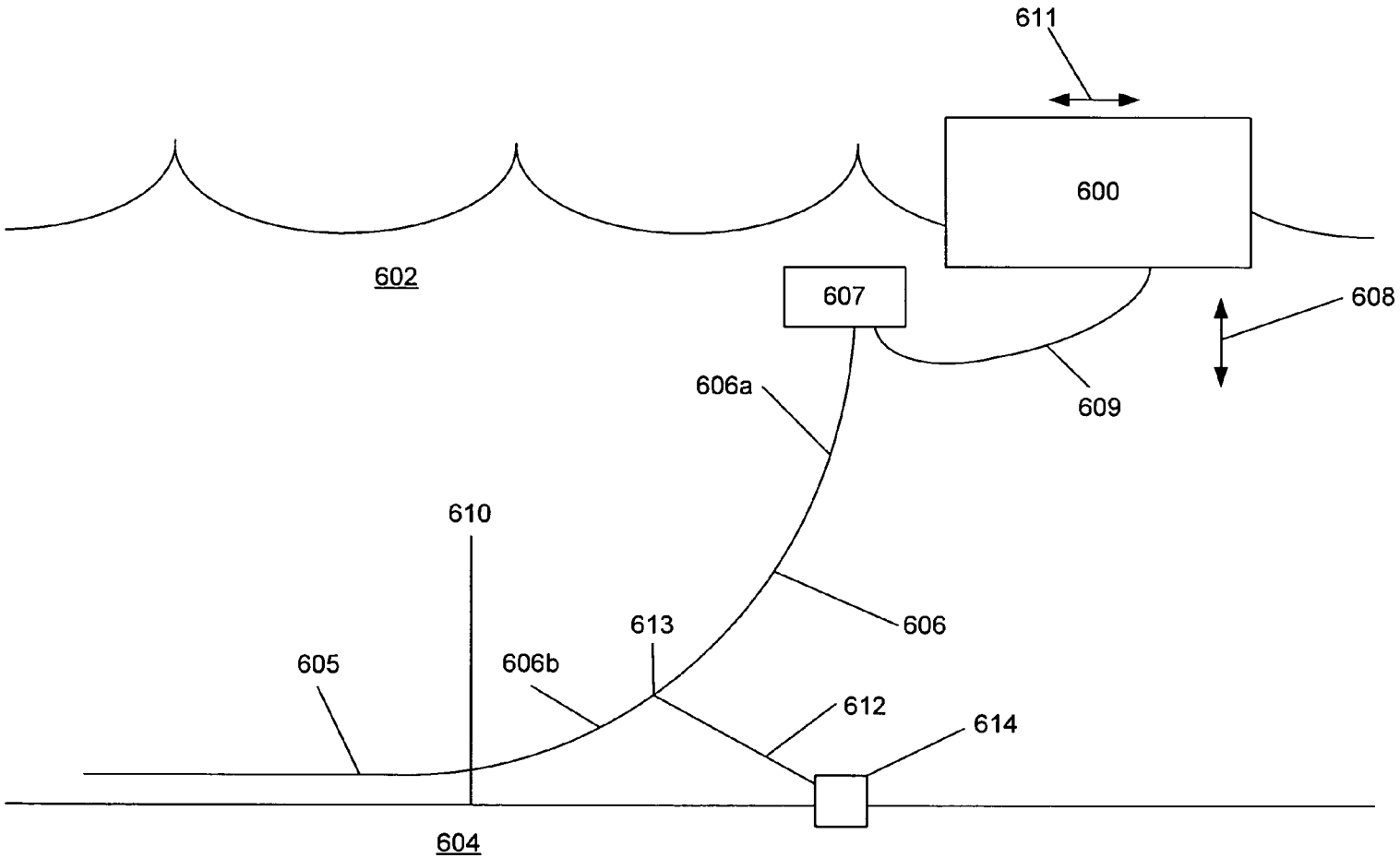
FIG. 6 illustrates pipe 606 top-supported by buoyancy member 607 and anchored at point 613 to seabed foundation 614 through cable 612. Anchoring point 613 divides pipe 606 into a substantially vertical line 606*a* and catenary configuration 606*b* with touchdown 610 at water bottom 604. Long flexible hose 609 connects buoyancy member 607 to vessel 600. Pipe 606 is isolated from the both horizontal and vertical motions (arrows 611 and 608) of vessel 608.

In some embodiments, referring now to FIG. 6, another option of supplying horizontal force from an anchored cable is illustrated. Vessel 600 is shown floating in body of water 602. Pipe 606 is almost vertically hung on buoyancy 607, and extending down into the water. The top of pipe 606 is connected to vessel 600 by flexible hose 609. Point 613 in the lower portion 606*b* of steel pipe 606 is anchored to foundation 614 by anchor line 612. Anchor line is slanted from vertical, for example from about 15 to about 60 degrees, and provides a horizontal force to anchoring point 613. Below anchoring point 613, pipe 606 forms a catenary configuration until touch down region at 610, where pipe 606 reaches water bottom 604 to connect to flowline 605 lying on the seabed. In some embodiments, anchoring point 613 divides pipe 606 into substantially vertical portion 606*a* and catenary portion 606*b*.

Any of the numerous buoyancy materials as are known may be utilized for buoyancy 607, for example a syntactic foam or buoyancy can. Buoyancy member 607 may incorporate materials with densities suitable to provide buoyancy, and/or may incorporate voids or hollow members to provide buoyancy.

It should be understood that the manner of anchoring line 612 is not critical, but rather a manner of design preference. Line 612 can be a cable, wire, chain, rope, or rod, and the like.

The offset and oscillations in horizontal direction (as arrow 611) and the vertical oscillation (as arrow 608) of vessel 600 may be effectively absorbed by flexible hose 609 and further isolated by anchoring point 613. The fatigue life at touch-down region 610 can be quite long, for example up to about 500, 1000, or 2000 years.

In some embodiments, pipe 606 can freely stand in water 602 when disconnected from host 600. Pipe 606 may be pre-installed before host 600 arrives. Under extreme environmental conditions or other situations, vessel 600 is allowed to disconnect flexible hose 609 and move away, leaving pipe 606 standing in water 602 by itself.

Figure 6A:
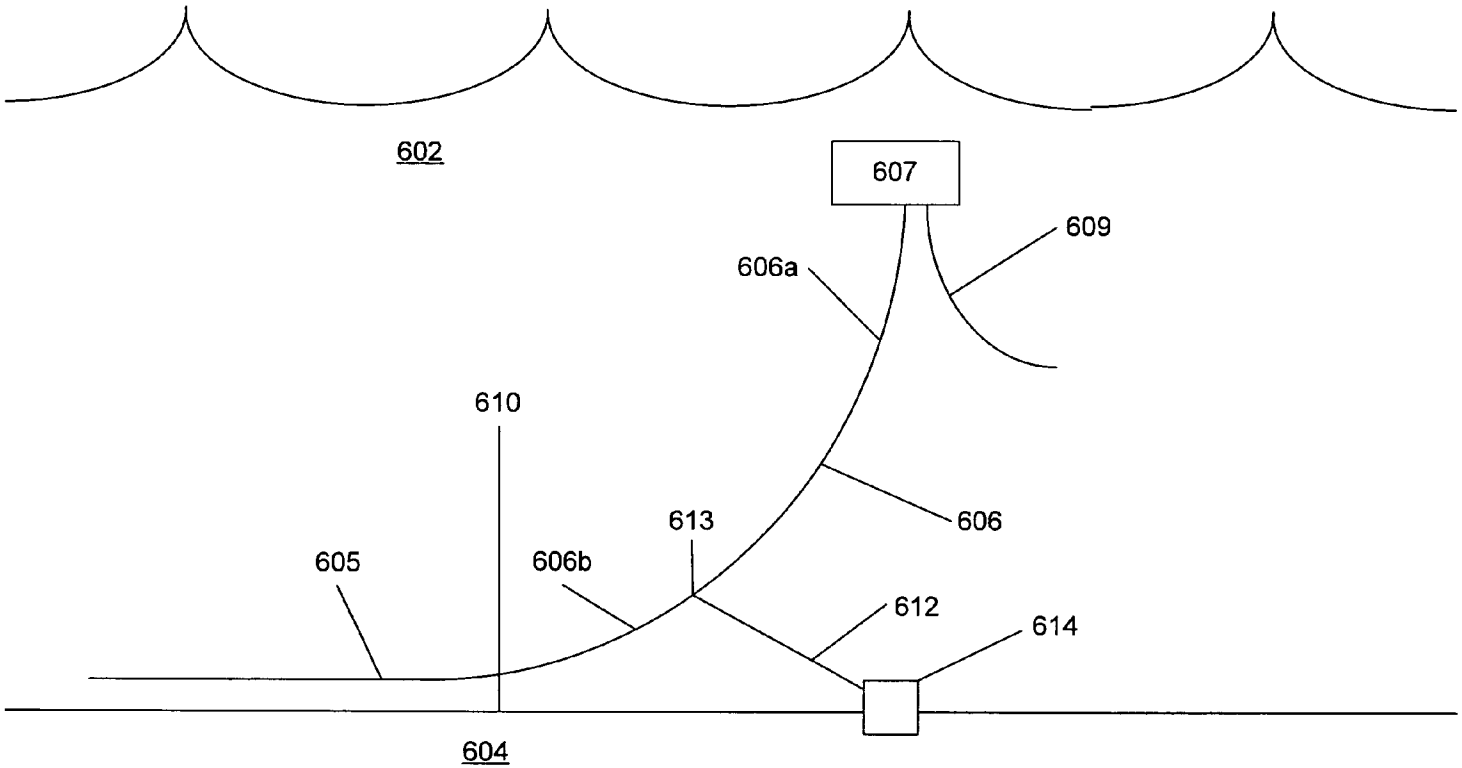
FIG. 6*a* illustrates another feature of the system in FIG. 6. The underwater line structure can be freestanding when hose 609 is disconnected from vessel 600.

In some embodiments, referring now to FIG. 6*a*, a disconnect mode is illustrated, in which flexible hose 609 is disconnected from vessel 600 and hung on buoyancy 600. Pipe 606 is vertically hung at its top on buoyancy 607, and anchored at anchoring point 613 to foundation 614 through cable 612. The anchoring tension produces a catenary configuration to the lower portion 606*b* of steel pipe 606, until touch down region 610 on water bottom 604.

In some embodiments, anchoring point 613 is an intersection of substantially vertical pipe 606*a* and catenary pipe 606*b*; where bending stress may become a concern. To reduce the bending stress to acceptable levels, one or more of the following measures can be used:

(1) Tapered steel stress joints at anchoring point 613 to reduce the bending stress;
(2) Bell-mouth or other bending restrictors in the vicinity of anchoring point 613 to limit the bending curvature below an acceptable upper bound;
(3) Stress joints made of titanium or another material, which allows larger bending curvature than pipe 606 material, at anchoring point 613;
(4) A pre-fabricated bent joint at anchoring point 613 to create a zero mean bending moment;
(5) Impose plastic (permanent) bending on a short segment near anchoring point 613 during installation, creating zero average bending moment.

In some embodiments, content variation inside pipe 606 and the buoyancy change of buoyancy member 607 will not affect the configuration of the line structure. Buoyancy member 607 is always well below water surface 602 to avoid collisions with passing boats.

In some embodiments, the horizontal offset and oscillations of vessel 600 (shown as arrow 611) has little effect to the motions of buoyancy 607 and steel pipe 606. The offset and motions of buoyancy 607 is largely determined by the wave/current loads. The relative motions between buoyancy 607 and vessel 600 may be large. The distance between buoyancy 607 and vessel 600 may be large, for example from about 100 to about 1000 meters, such as 500 meters, to ensure tolerable end rotation range of flexible hose 609.

In some embodiments, a suitable installation method is to lay down all the pipes 606 by a laying barge to the seafloor as the first step. Later, according to the schedule, the top of one of the pipes 606 is lifted by a winch to the surface and is connected to buoyancy member 607. Anchoring line 612 can be connected to pipe 606 by an ROV. The underwater line structure is then freestanding in the water. After the host vessel 600 arrives, flexible hose 609 may connected to vessel 600.

Figure 7:
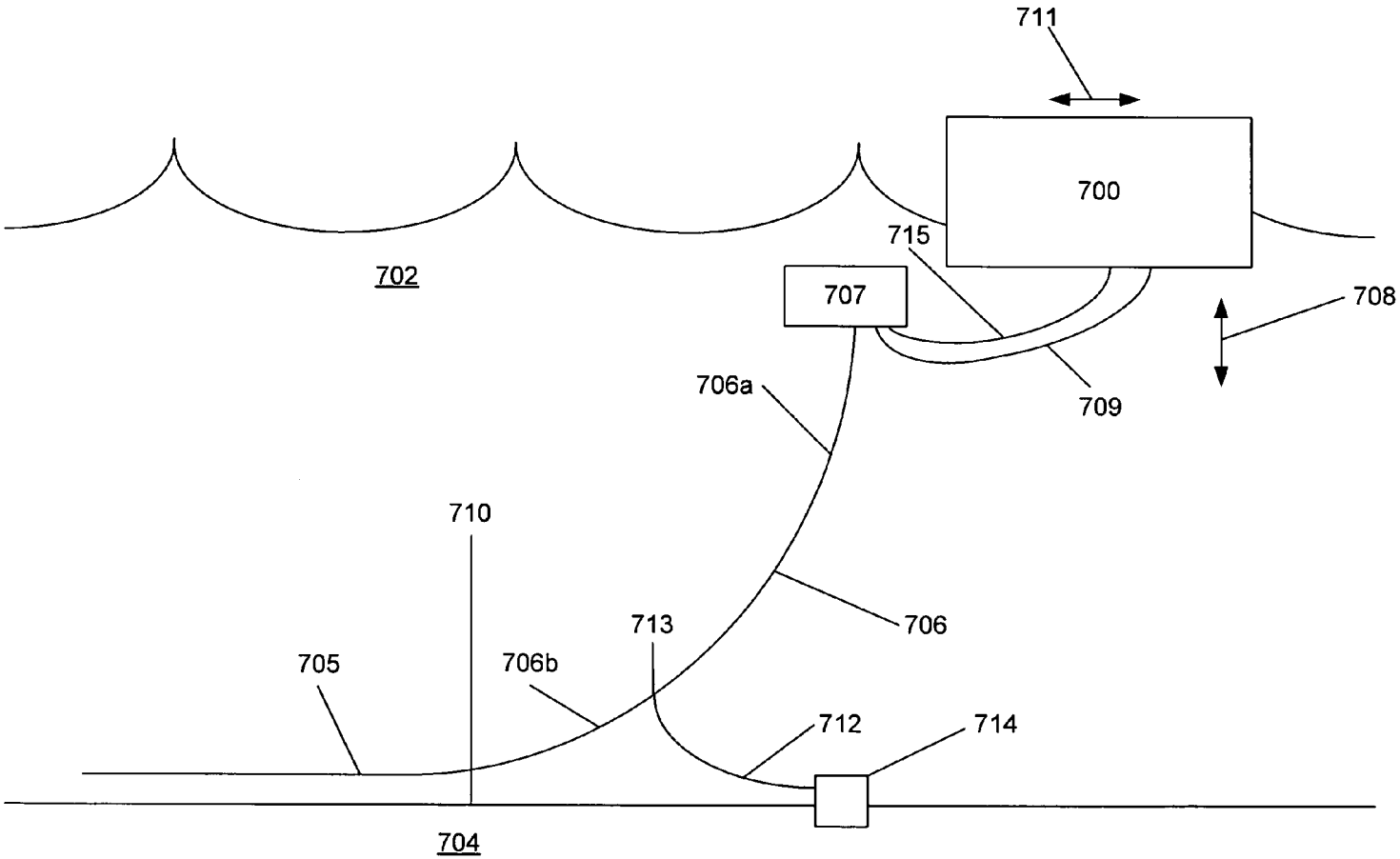
FIG. 7 illustrates the normal working condition of the system in which anchoring cable 712 is slack, and horizontal loads required for a catenary configuration of pipe 706 is supplied by chain 715 and flexible hose 709. When vessel 700 is disconnected, steel pipe 706 stands by itself with chain 715 and flexible hose 709 hung on buoyancy member 707.

In some embodiments, referring now to FIG. 7, another system is illustrated. After flexible hose 709 and chain 715 are connected to vessel 700, anchoring line 712 becomes slack. During normal working periods, anchoring line remains slack, and flexible hose 709 and chain 715 may be used to transmit horizontal offset and motion (arrow 711) from vessel 700 to buoyancy 707, and to isolate the vertical oscillation (arrow 708). The distance between buoyancy 707 and vessel 700 is less varied and can be short, or required length for flexible hose 709 may be relatively short.

During disconnect mode, such as pre-installation or sever weather conditions under which vessel 700 may be away from the scene, flexible hose 709 and chain 715 may be disconnected from vessel 700 and loosely hung on buoyancy 700. Pipe 706 is vertically hung at its top on buoyancy 707, and anchored at anchoring point 713 to foundation 714 through line 712. Line 712 is taut and the anchoring load produces a catenary configuration to lower portion 706*b* of steel pipe 706, until touch down 710 on water bottom 704.

Figure 7A:
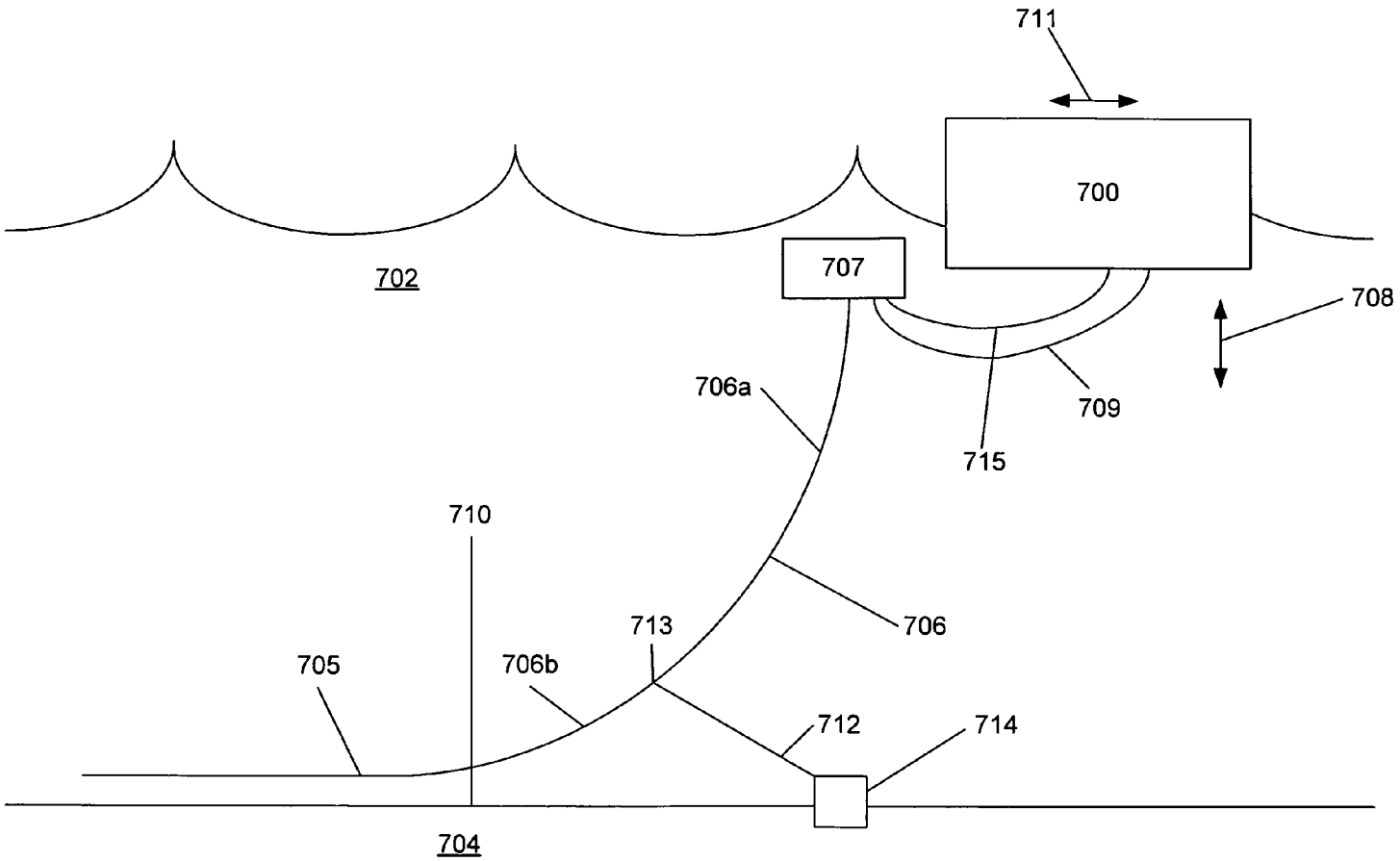
FIG. 7*a* illustrates the non-working condition of the system in which there is a loss of the liquid content inside pipe 706. In this condition, buoyancy member 707 rises up and tightens anchoring cable 712, so that the top of buoyancy member 707 is still below the bottom of passing boats.

In some embodiments, in case of loss of fluid contents inside pipe 706 (see FIG. 7*a*), buoyancy 707 will rise up, and anchoring line 712 is taut to keep buoyancy 707 below the bottom of passing boats.

It should be understood, that floating host (400, 500, 600, and 700) may be any type of floating structure having a line member extending toward the water bottom. For example, in the offshore hydrocarbon exploration, drilling, production, drilling, processing, or transportation art, non-limiting examples of floating hosts include ships, boats, barges, rigs, platforms, FPSOs (Floating Production, Storage and Offloading systems), semisubmersibles, FSRUs (Floating, Storage and Regassification Unit), and the like.

Elongated underwater line structure may be any type of structure that extends from floating host as are known in the offshore drilling be art. Most commonly, underwater line structure will be some sort of tubular member, generally referred to in the art as a "riser," non-limiting examples of which include umbilicals, tubes, ducts, pipes, conduits, but also may be a nontubular member such as cables, lines, tethers, and the like.

While the present invention may be utilized for installing a new underwater line structure, it will also find utility in a method of modifying an existing underwater structure.

While the illustrative embodiments of the invention have been described with particularity, it will be understood that various other modifications are apparent to and can be readily made by those skilled in the art without departing the spirit and scope of the invention. Accordingly, it is not intended that the scope of the claims appended hereto be limited to the examples and descriptions set forth herein but rather that the claims be construed as encompassing all the features of patenable novelty which resides in the present invention, including all features which would be treated as equivalents thereof by those skilled in the art to which this invention pertains.

EXAMPLES

Example 1

A production riser 8.625" (0.22 m) OD and 1.51" (0.038 m) wall may be used to deliver oil production to a production offshore platform in 1000-meter water. The load to support a conventional steel catenary riser is about 136 tons, which is beyond the remaining deck load capacity of the platform. If a hybrid riser in FIG. 3 is used, then the deck load is only 41 tons, but requiring a riser base and tiebacks.

The embodiment illustrated in FIG. 4 would include a 180-meter flexible hose and 140-meters long chain (95 mm OD), and an aircan of 130-ton net buoyancy. Then the deck load may be as small as 36 tons. During normal oil production, the top of the aircan is 72 meters below the water surface. In a pipe empty state, the aircan may rise, but its top is still 41 meters below the sea surface, below the bottom of the passing boats. Other responses, such as stress levels, fatigue life; flexible hose motions, etc. are all satisfied. This configuration may achieve significant cost savings and simplified installation compared to the hybrid riser described in FIG. 3.

Example 2

A production riser 10.75"×0.875" (0.27×0.022 meters) is required to connect to a turret FPSO in 1760 meter water. The heave oscillations of the turret are so large that the fatigue life of a conventional SCR configuration as shown in FIG. 1 can only last hours at its touchdown region. The lazy wave riser configuration in FIG. 2 can lengthen the fatigue life in the touchdown region, with a sacrifice of fatigue lives of the upper portion and installation difficulty. The hybrid riser described in FIG. 3 can with a high cost, including a foam module of 215 ton net buoyancy, riser base, tiebacks, etc.

The embodiment illustrated by FIG. 6 may be used, including a 400-meter flexible hose, and an aircan of 190-ton net buoyancy. A pre-bent pipe segment around the anchoring point may be formed during installation. After the anchoring cable is connected, a pull-up on purpose at the riser top forces a short segment of the pipe at the anchoring point to bend permanently (plastically). The elastic stress level near the anchoring point becomes low. The fatigue life in the touchdown region is as long as 5000 years with a safety factor 10. This configuration may achieve significant cost savings and simplified installation compared to the hybrid riser described in FIG. 3.

That which is claimed is:

1. A floating system positioned in a body of water having a water bottom, the system comprising:
- a host member floating on a surface of the water;
- a flotation module floating under the surface of the water;
- a flexible hose connecting the host member to the flotation module;
- a line connecting the host member to the floatation module, wherein the line comprises a heavy chain, a heavy line member, or a taut line; and
- an elongated underwater line structure, comprising:
  - a top portion connected to the flotation module and
  - a bottom portion extending to the water bottom and adapted to connect to a flowline lying on the water bottom, wherein at least one of the top portion and the bottom portion comprise a catenary configuration.

2. The floating system of claim 1, wherein the elongated underwater structure comprises a steel catenary riser.

3. The floating system of claim 1, wherein the line comprises a heavy chain or other heavy line member with sufficient mass to produce a horizontal force required to form a catenary configuration of the elongated underwater line structure.

4. The floating system of claim 1, further comprising an anchor member connected to the elongated underwater line structure.

5. The floating system of claim 1, wherein the flexible hose comprises a sufficient mass to produce a horizontal force required to form a catenary configuration of the elongated underwater line structure.

6. The floating system of claim 1, wherein the line connecting the host member to the flotation module is a taut line connecting the host member to the flotation module to produce a horizontal force required to form a catenary configuration of the elongated underwater line structure.

7. The floating system of claim 1, further comprising a plurality of anchor members connected to the elongated underwater line structure.

8. The floating system of claim 1, further comprising a concrete bell-mouth sitting on the water bottom, which makes the bottom portion, in an emergency, stand in the water by itself without any connections to the host, resulting in plastic bending deformation without material rupture.

9. The floating system of claim 1, wherein the flotation module is floating at a depth from about 25 to 100 meters below the surface of the water.

10. The floating system of claim 1, wherein the elongated underwater line structure comprises at least one of a pre-curved shore pipe, a bell-mouth, a bending restrictor, a tapered stress joint, a titanium stress joint, a flexible hose, and a deep-water flexible joint.

11. The floating system of claim 1, further comprising a set of bending restrictors sitting on the water bottom, which makes the bottom portion, in an emergency, stand in the water by itself without any connections to the host, resulting in plastic bending deformation without material rupture.

12. The floating system of claim 1, wherein the bottom portion comprises a catenary configuration.

13. The floating system of claim 1, wherein the elongated underwater line structure is adapted to be disconnected from the host member and stand in the water by itself.

14. The floating system of claim 1, wherein the host member is allowed to move away due to severe environmental conditions or other situations with disconnection of the flexible hose, and the elongated underwater line structure is supported by the flotation module vertically and an anchor horizontally.

15. The floating system of claim 1, further comprising an anchor member connected to an anchoring point in the elongated underwater line structure, which is slack in normal working conditions and in no use.

16. A method of modifying a floating system, the system comprising a host floating in a body of water having a water bottom, an elongated underwater structure with a first end, a second end, and a body positioned between the first end and the second end, with the first end connected to the host, the body extending through the water, and the second end adjacent the water bottom, the method comprising:
- disconnecting the first end from the host;
- connecting the first end to a flotation module;
- connecting a flexible hose to the flotation module and the host;

connecting a line to the flotation module and the host, wherein the line comprises a heavy chain, a heavy line member, or a taut line; and maintaining the flotation module at a depth below a surface of the body of water.

17. The method of claim 16, further comprising anchoring the body of the elongated underwater structure to the water bottom.

18. The method of claim 17, wherein an anchor line is connected to the body of the elongated underwater structure from 25 meters to 250 meters above the water bottom.

19. The method of claim 16, wherein the elongated underwater structure comprises a steel catenary riser.

20. The method of claim 16, wherein the flotation module at a depth from 5 to 50 meters below the surface of the body of water.

21. A floating system positioned in a body of water having a water bottom, the system comprising:

a host member floating on a surface of the water;

a flotation module floating under the surface of the water;

a flexible hose connecting the host member to the flotation module; and an elongated underwater line structure, comprising:

at least one of a pre-curved shore pipe, a bell-mouth, a bending restrictor, a tapered stress joint, a titanium stress joint, a flexible hose, and a deep-water flexible joint;

a top portion connected to the flotation module; and a bottom portion extending to the water bottom and adapted to connect to a flowline lying on the water bottom, wherein at least one of the top portion and the bottom portion comprise a catenary configuration.

* * * * *